US005791027A

United States Patent [19]

Harrison et al.

[11] Patent Number: 5,791,027

[45] Date of Patent: Aug. 11, 1998

[54] SEAT BELT BUCKLE

[75] Inventors: Mark John Harrison, Belfast; Michael John Jackson, Cullybackey, both of United Kingdom

[73] Assignee: European Components Co. Limited, Belfast, United Kingdom

[21] Appl. No.: 856,007

[22] Filed: May 14, 1997

[30] Foreign Application Priority Data

May 14, 1996 [GB] United Kingdom ..... 9610090

[51] Int. Cl.[6] ..... A44B 11/00

[52] U.S. Cl. ..... 24/641; 24/642; 24/652

[58] Field of Search ..... 24/641, 642, 643, 24/644, 645, 646, 651, 652, 196

[56] References Cited

U.S. PATENT DOCUMENTS

| | | | |
|---|---|---|---|
| 3,274,656 | 9/1966 | Hamann | 24/196 |
| 4,095,313 | 6/1978 | Piljay et al. | 24/643 |
| 4,899,424 | 2/1990 | Barnes et al. | 24/641 |
| 5,100,176 | 3/1992 | Ball et al. | 24/196 |

FOREIGN PATENT DOCUMENTS

| | | |
|---|---|---|
| 0 098 726 | 1/1984 | European Pat. Off. . |
| 2 110 292 | 6/1983 | United Kingdom . |
| 2 151 691 | 7/1985 | United Kingdom . |
| 91 06231 | 5/1991 | WIPO . |

*Primary Examiner*—Victor N. Sakran
*Attorney, Agent, or Firm*—Foley & Lardner

[57] ABSTRACT

A buckle for a seat belt of a motor vehicle has a frame 10 including a base and upstanding side walls, a lock pin 12 extending between the side walls, a lock bar 18 engagable in an aperture 26 in a latch plate 24 associated with the seat belt, a slider 16 connected with the lock bar 18, said slider 16 being retained under the lock pin 12 when the lock bar 18 is engaged in a latch plate aperture 26, a release button 20 for releasing said slider 16 from the lock pin 12 and thus releasing the lock bar 18 from engagement with the aperture 26 in the latch plate 24. At least one portion of the lock pin 12 contacted by the slider 16 is rotatably mounted within the buckle and is rotated by the motion of the slider 16 during the course of insertion into and/or release from the buckle of a latch plate 24.

12 Claims, 2 Drawing Sheets

SEAT BELT BUCKLE

BACKGROUND OF THE INVENTION

The present invention relates to seat belt buckles.

Seat belt buckles are well known in which a latch plate attached to a seat belt can be inserted into a slot in the buckle. The seat belt and buckle are secured to the vehicle bodywork. A lock bar in the buckle releasably engages an aperture in the latch plate to prevent the latch plate from coming out of the buckle, particularly in a motor accident, thereby restraining the occupant of the seat. Pressing on a release button of the buckle disengages the lock bar from the latch plate and enables the latch plate to be released from the buckle and the seat belt to be removed from the occupant.

A conventional buckle comprises a rigid frame including a base, upstanding side walls adapted to guide the latch plate longitudinally of the frame, a lock pin extending transversely of the frame between the side walls, said lock pin being spaced above the base, a locking lever pivotally mounted on the frame and pivotal between a latched position and an unlatched position, said locking lever carrying a projecting lock bar engagable in said aperture in the latch plate to retain the latch plate in place, a slider slidable longitudinally of the locking lever between a first position in which it is located under and in contact with said lock pin, to retain the locking lever in the latched position and a second position in which it allows said locking lever to pivot to its unlatched position and a slider spring urges the slider towards its first position.

A release button is provided to push the slider to its second position, the slider being resiliently urged by the slider spring against the rear of the lock pin to retain the locking lever in its unlatched position. On inserting the latch plate into the slot of the buckle, the slider is released so that the slider spring may urge it to its first position under the lock pin and the locking lever may pivot to its latched position engaging the aperture in the latch plate with the lock bar.

One such form of seat belt buckle is disclosed, for example, in WO-91/06231.

In such a conventional buckle the lock pin is rigidly fixed between the side walls of the frame and has an approximately rectangular cross section. In seat belt buckles, it is important that upon inserting a latch plate into the buckle, the slider moves reliably from the second position in which it is urged against the rear of the lock pin to the first position in which it is located under the lock pin, to ensure that the lock bar engages the aperture of the latch plate and that the locking lever is latched in its lower position. Similarly, it is important that when the release button is pressed, the slider moves smoothly and reliably from the first position to the second position so that the locking lever can move from its latched to its unlatched position to disengage the lock bar from the latch plate aperture so that the latch plate can be ejected from the buckle. However, with the conventional lock pin there is a tendency for friction between the slider and the sides of the lock pin to cause the motion of the slider to stall so that insertion and ejection of the latch plate is unreliable. Moreover, the motion of the slider occurs in two stages, namely, parallel and perpendicular to the direction of insertion of the latch plate and there is a transition between these two stages so that the overall motion of the slider is not smooth.

SUMMARY OF THE INVENTION

It is an object of the present invention to alleviate, at least partially, the above-mentioned drawbacks of a conventional seat belt buckle.

Accordingly the present invention provides a buckle in which at least one portion of the lock pin contacted by the slider is rotatably mounted within the buckle so that it may be rotated by the motion of the slider during the course of insertion into and/or release from the buckle of said latch plate.

The construction of such a seat belt buckle helps to prevent any potential stalling of the slider movement and assists the smooth operation of the buckle.

BRIEF DESCRIPTION OF THE DRAWINGS

Specific embodiments of the invention will now be described by way of example only with reference to the accompanying drawings in which.

DETAILED DESCRIPTION

Figure 1:
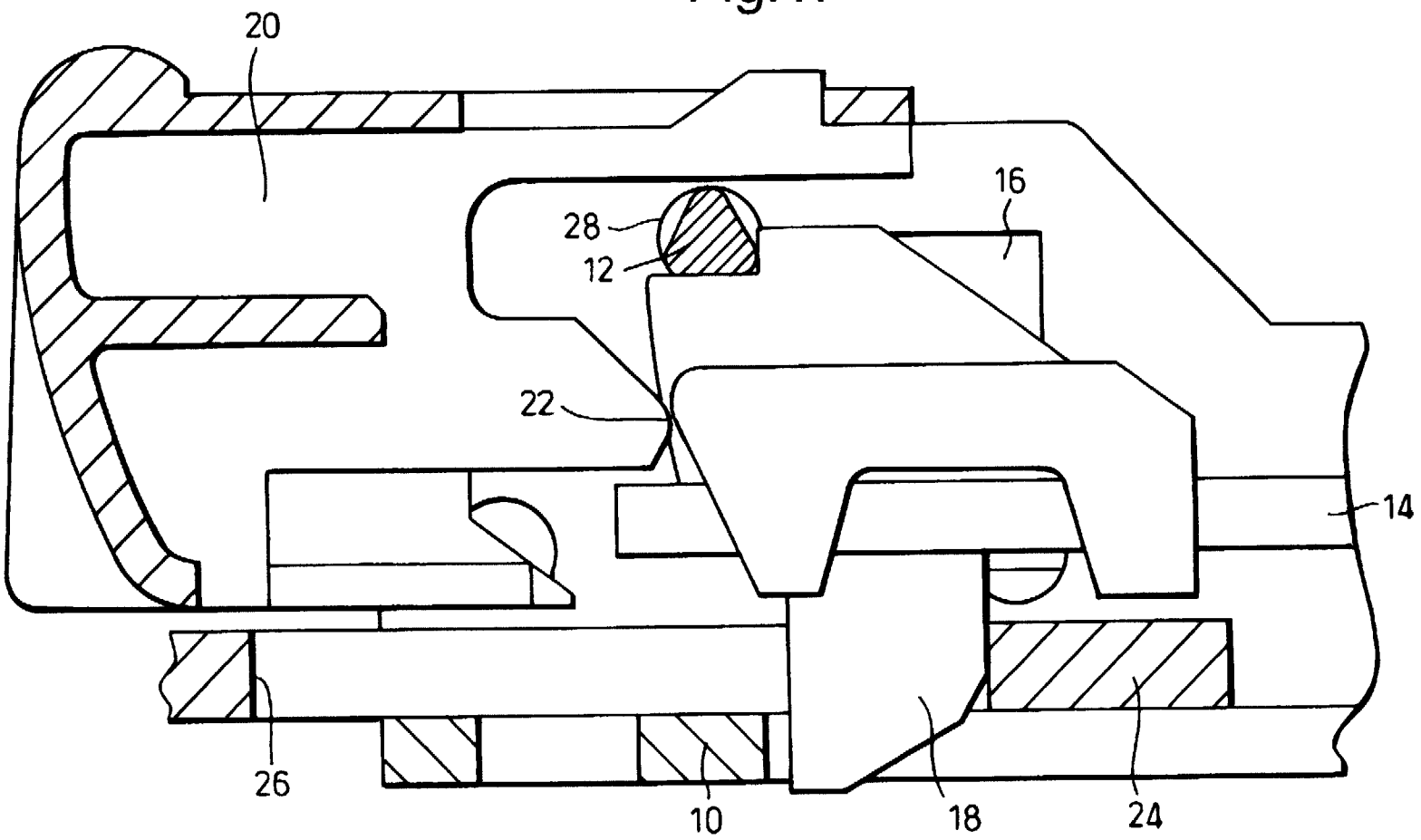
FIG. 1 shows, in section, a portion of a buckle according to the invention with a latch plate inserted therein.

Referring to FIG. 1, which illustrates a buckle similar to that disclosed in EP-B-0,452,464, the buckle consists of a channel section frame 10 having side walls with a lock pin 12 extending therebetween. Pivotally mounted between the side walls is a locking lever 14 on which is slidably mounted a plastics material slider 16, which is urged to the left by a slider spring (not shown). The locking lever 14 carries a downwardly extending lock bar 18.

FIG. 1 shows the locking lever 14 in the lower latched position and the slider 16 in its first position located under the lock pin 12. The buckle is also provided with a release button 20 axially slidable relative to the frame 10 and including an abutment 22 engagable with the slider 16. The opposing surfaces of the release button 20 and the slider 16 are chamfered. When the release button 20 is pushed to the right, the slider initially slides to the right along the locking lever 14, but is still retained under the lock pin 12. After the release button 20 has travelled a certain distance, the slider 16 can begin to move upwards, which will be described in greater detail later. The chamfered surfaces of the push button 20 and the slider 16 produced an upward force on the slider 16.

Below the lower surface of the release button 20, and a facing upper surface of a portion of the frame 10, there is formed an elongate slot into which may be inserted a latch plate 24 having an aperture 26. The lock bar 18 is shown engaged in this aperture 26 and is normally retained in this position by the action of the lock pin 12 thereby preventing movement of the locking lever 14. When the slider 16 moves upwards under the action of the release button 20, the locking lever 14 will pivot clockwise lifting with it the lock bar 18 which becomes disengaged from the aperture 26, whereupon the latch plate 24 is ejected from the buckle by a spring loaded ejector (not shown). The locking lever 14 is now in its upper position and the slider 16 is in its second position in which the slider 16 is to the right of the lock pin 12 and is urged against the right hand side of the lock pin 12 by the slider spring (not shown).

When a latch plate 24 is inserted into the slot of the buckle which is in the resulting position described above, the latch plate 24 pushes against the ejector (not shown), which in turn pushes against a portion (not shown) of the locking lever 14 which pivots the locking lever counterclockwise and lowers the lock bar 18 into the aperture 26 of the latch plate 24 and moves the slider 16 downwards against the right hand side of the lock pin 12. The action of the slider spring (not shown) then pushes the slider 16 to the left relative to the locking lever 14 which engages the slider 16 underneath the lock pin 12 and latches the locking lever 14 in its lower position and returns the slider 16 to its first position.

In the illustrated embodiment the lock pin 12 consists of a metal bar of approximately triangular cross-section. The edges where the faces of the lock pin 12 meet are rounded and the lock pin 12 is mounted in circular holes 28 provided in each side wall of the frame 10 such that the lock pin 12 can rotate about its axis 29.

Figure 2:
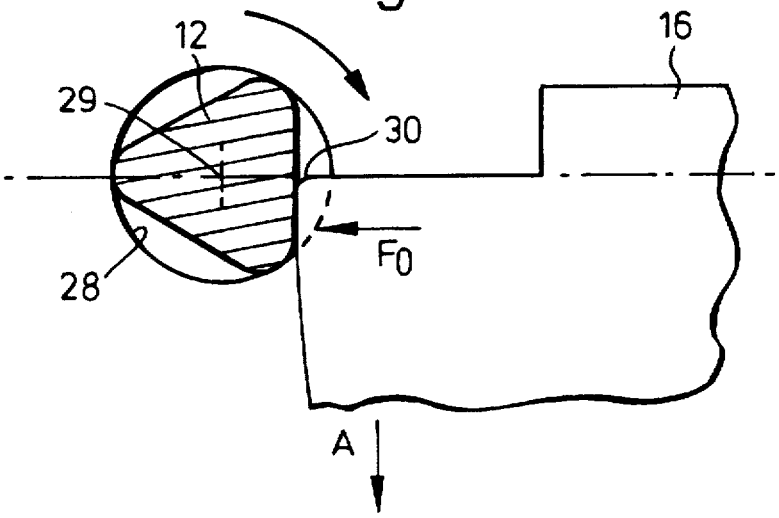
FIGS. 2 and 3 illustrate the operation of the lock pin and slider according to the invention.

With reference to FIG. 2, the operation of the lock pin and slider will be described in greater detail for the insertion of a latch plate 24 into the buckle. The slider 16 begins in its second position to the right of the lock pin 12, but urged to the left by the force $F_0$, caused by the slider spring. The insertion of the latch plate 24 causes the aforementioned counterclockwise rotation of the locking lever 14 which causes a downward movement of the slider shown by the arrow A in FIG. 2. When the shoulder 30 of the slider 16 passes below the level of the axis 29 of the lock pin 12, the slider 16 can begin to move to the left under the influence of the slider spring, and the lock pin 12 is rotated clockwise. The slider 16 continues to move downwards and to the left until the lock pin 12 is fully on top of the slider 16 in the position shown in FIG. 1.

Figure 3:
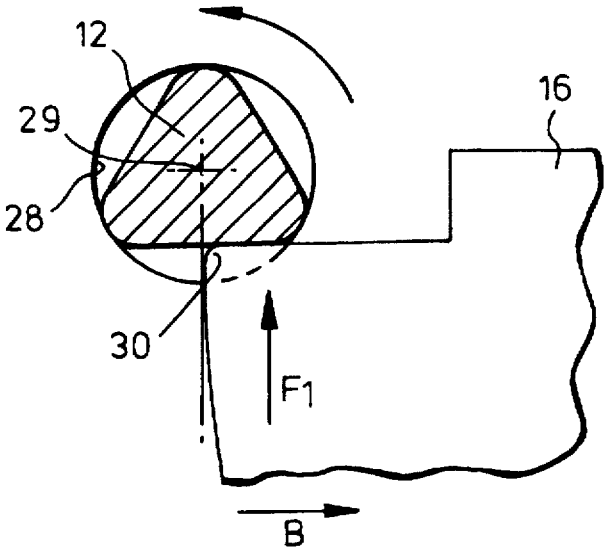

The release operation of the buckle can be understood from FIG. 3. The slider 16 and lock pin 12 will be initially in the position shown in FIG. 1. Pushing the release button 20 moves the slider 16 to the right as shown by the arrow B in FIG. 3. The chamfered surfaces of the release button 20 and slider 16 produce an upward force $F_1$, on the slider 16. When the shoulder 30 of the slider 16 passes to the right of the plane containing the axis 29 of the lock pin 12 shown in FIG. 3, the force $F_1$ begins to move the slider 16 upwards which rotates the lock pin 12 counterclockwise. The rightward and upward motion of the slider 16 continues which raises the locking lever 14 to its upper position and returns the slider 16 to its second position pressing against the right hand side of the lock pin 12.

Enabling the lock pin to rotate assists the movement of the slider thereby reducing the risk of it stalling and moves the shoulder 30 of the slider 16 in a curved path, resulting in a smoother operation.

Clearly the lock pin 12 could have cross-sections (e.g., circular, elliptical, cam-shaped, or polygonal) other than triangular, but this shape is presently preferred as it provides a relatively large load bearing area between the lock pin 12 and the slider 16 which can be important under certain conditions, such as in an accident. The edges of the lock pin are rounded which reduces potential damage to the slider 16 and also enables the lock pin 12 to rotate smoothly in the circular holes 28 provided in the side walls of the frame 10.

Figure 4:
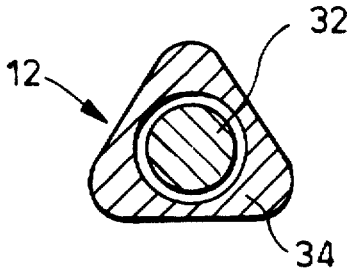
FIG. 4 shows another form of the lock pin according to the invention.

Alternative methods of rotatably mounting the lock pin in the seat belt buckle could of course also be used for the present invention. For example, the lock pin need not be of constant cross-section, but could be triangular only in the region where it is contacted by the slider, and the two ends, which engage in the frame, could be of circular profile. Alternatively, as shown in FIG. 4, the lock pin 12 could comprise a shaft 32 extending across the frame on which is rotatably mounted a component 34 of triangular cross-section for contacting the slider 16. The shaft 32 could be a metal pin and the rotatable component 34 could be a triangular prism-shaped piece of plastics material with an axial bore to accommodate the shaft 32.

What is claimed is:

1. A buckle for a seat belt, said seat belt including an associated latch plate, and said latch plate having an aperture therein, said buckle comprising:

a frame including a base and upstanding side walls;

a lock pin extending between the side walls;

a lock bar engageable in said aperture in said latch plate;

a locking lever connected with the lock bar;

a slider slidable along the locking lever while in contact with said lock pin, said lock pin being effective to retain said slider under the lock pin when the lock bar is engaged in said latch plate apertures; and a release button for releasing said slider from said lock pin and thus releasing the lock bar from engagement with the aperture in the latch plate, wherein at least one portion of the lock pin contacted by the slider is rotatably mounted within the buckle so that it is rotated by the motion of the slider during the course of insertion into and/or release from the buckle of said latch plate.

2. A buckle according to claim 1, wherein said at least one portion of the lock pin is of polygonal cross-section.

3. A buckle according to claim 2, wherein said polygonal cross-section of said at least one portion of the lock pin comprises corners that are rounded.

4. A buckle according to claim 2, wherein said polygonal cross-section of said at least one portion of the lock pin is substantially an equilateral triangle.

5. A buckle according to claim 1, wherein each side wall of the frame further comprises a hole rotatably retaining the lock pin.

6. A buckle according to claim 5, wherein said hole is substantially circular.

7. A buckle according to claim 1, wherein said at least one portion of the lock pin contacted by the slider comprises a component rotatably mounted on a shaft extending between the side walls.

8. A buckle according to claim 1, wherein the lock pin is rotatably mounted about a center axis of the lock pin.

9. A buckle according to claim 1, wherein said at least one portion of the lock pin is of circular cross-section.

10. A buckle according to claim 1, wherein said at least one portion of the lock pin is of elliptical cross-section.

11. A buckle according to claim 1, wherein said at least one portion of the lock pin is of polygonal cross-section.

12. A buckle for a seat belt, said seat belt including an associated latch plate, and said latch plate having an aperture therein, said buckle comprising:

a frame including a base and upstanding side walls;

a lock pin extending between the side walls;

a lock bar engageable in said aperture in said latch plate;

a locking lever connected with the lock bar;

a slider slidable along the locking lever while in contact with said lock pin, said lock pin retaining said slider under the lock pin when the lock bar is engaged in said latch plate aperture; and a release button for releasing said slider from said lock pin and thus releasing the lock bar from engagement with the aperture in the latch plate, wherein at least one portion of the lock pin contacted by the slider is rotatably mounted within the buckle so that it is rotated about its center axis by the motion of the slider during the course of insertion into and/or release from the buckle of said latch plate, wherein at least one portion of the lock pin is of an equilateral triangle cross-section, wherein said equilateral triangle cross-section has corners that are rounded, and wherein each side wall of the frame further comprises a hole rotatably retaining the lock pin.

* * * * *